US009661904B2

(12) United States Patent
Yun

(10) Patent No.: US 9,661,904 B2
(45) Date of Patent: May 30, 2017

(54) TRAVEL BAG HAVING EXTRA STORAGE COMPARTMENT

(71) Applicant: Heecheol Yun, Incheon (KR)

(72) Inventor: Heecheol Yun, Incheon (KR)

( * ) Notice: Subject to any disclaimer, the term of this patent is extended or adjusted under 35 U.S.C. 154(b) by 0 days.

(21) Appl. No.: 15/191,754

(22) Filed: Jun. 24, 2016

(65) Prior Publication Data

US 2016/0302542 A1 Oct. 20, 2016

Related U.S. Application Data

(63) Continuation of application No. PCT/KR2014/003563, filed on Apr. 23, 2014.

(30) Foreign Application Priority Data

Dec. 31, 2013 (KR) ..... 10-2013-0169352

(51) Int. Cl.

| | |
|---|---|
| ***A45C 5/03*** | (2006.01) |
| ***A45C 7/00*** | (2006.01) |
| ***A45C 5/04*** | (2006.01) |
| ***A45C 5/14*** | (2006.01) |
| ***A45C 13/12*** | (2006.01) |

(52) U.S. Cl.

CPC ..... *A45C 7/0045* (2013.01); *A45C 5/03* (2013.01); *A45C 5/04* (2013.01); *A45C 5/14* (2013.01); *A45C 7/00* (2013.01); *A45C 7/0036* (2013.01); *A45C 7/0077* (2013.01); *A45C 7/0086* (2013.01); *A45C 13/123* (2013.01)

(58) Field of Classification Search

CPC ..... A45C 7/0045; A45C 5/03; A45C 5/04; A45C 5/14; A45C 7/00; A45C 7/0036; A45C 7/0077; A45C 7/0086; A45C 13/123

See application file for complete search history.

(56) References Cited

U.S. PATENT DOCUMENTS

| | | | | | |
|---|---|---|---|---|---|
| 1,513,909 | A | * | 11/1924 | Hunter | A45C 7/0063 190/103 |
| 1,636,838 | A | * | 7/1927 | Roser | A45C 7/0063 190/103 |
| 2,457,422 | A | * | 12/1948 | Warner | A45C 3/04 383/10 |
| 3,685,620 | A | * | 8/1972 | Schneider | A45C 3/00 190/114 |
| 4,119,181 | A | * | 10/1978 | Jones | A45C 5/03 119/600 |

(Continued)

*Primary Examiner* — Tri Mai

(74) *Attorney, Agent, or Firm* — Park & Associates IP Law, P. C.

(57) ABSTRACT

The present invention relates to a travel bag having an extra storage compartment. The auxiliary storage compartment is formed of a flexible textile material and is attached to top of the travel bag in a folding manner. The auxiliary storage compartment is usually stored to be in close contact with the outside of the main body of the bag. When in use, the auxiliary storage compartment is unfolded upward for assembly so that another auxiliary storage compartment is formed. During travel, belongings such as a handbag, a camera, a cellular phone, etc. can be conveniently stored and kept temporarily during an immigration inspection at an airport or the like. Accordingly, utility of the travel bag can be more improved.

6 Claims, 6 Drawing Sheets

(56) References Cited

U.S. PATENT DOCUMENTS

| | | | | |
|---|---|---|---|---|
| 4,953,673 | A * | 9/1990 | Ambasz | A45C 7/0022 190/103 |
| 5,020,337 | A * | 6/1991 | Krieg | F25D 3/06 229/103 |
| 7,503,569 | B2 * | 3/2009 | Duvigneau | A45C 7/0045 190/110 |
| 2006/0086583 | A1 * | 4/2006 | Hoberman | A45C 7/0045 190/108 |

* cited by examiner

TRAVEL BAG HAVING EXTRA STORAGE COMPARTMENT

REFERENCE TO RELATED APPLICATIONS

This is a continuation of pending International Patent Application PCT/KR2014/003563 filed on Apr. 23, 2014, which designates the United States and claims priority of Korean Patent Application No. 10-2013-0169352 filed on Dec. 31, 2013, the entire contents of which are incorporated herein by reference.

FIELD OF THE INVENTION

The present invention relates to a travel bag having an extra storage compartment, and more particularly, to a travel bag having an extra storage compartment that is capable of allowing the extra storage compartment formed through assembling to be further provided to a general travel bag having a handle and casters, thereby permitting a traveler's portable items to be conveniently stored in the extra storage compartment if necessary.

BACKGROUND OF THE INVENTION

Generally, a travel bag, which is used on a long journey like a trip abroad, has casters mounted on the underside thereof and a movable handle insertedly mounted on the top thereof, so that when the travel bag is kept at a given place, the movable handle is inserted into the travel bag to make the volume of the travel bag reduced, and contrarily, when the travel bag is moved to another place, the movable handle is exposed to the outside to allow the whole travel bag to pull and move thereby.

According to the conventional travel bag, however, a traveler's portable items such as a handbag, a camera, a cell phone and the like are temporarily stored in a separate bag when he or she goes through immigration formalities at the airport or the like. So as to solve such inconveniences, there is proposed Korean Patent Application Laid-open No. 2013-98776 entitled "travel bag having variable storage chamber" as filed by the same applicant as the present invention, and the travel bag according to the prior art has an auxiliary storage chamber formed on top thereof to allow a traveler's portable items to be temporarily stored therein.

FIG. 7 is a perspective view showing a travel bag having a variable storage chamber according to the prior art. As shown in FIG. 7, there is provided a travel bag 1 having movable casters 11 mounted on the underside thereof and a slide-type movable handle 5 mounted on the top side thereof, including an auxiliary housing 7 slidingly disposed on the top side thereof upward and downward so that in normal cases, the auxiliary housing 7 is moved downward to come into close contact with the top side of the travel bag 1, and during the use of the travel bag, the auxiliary housing 7 is moved upward to form an auxiliary storage chamber 10.

According to the prior art, however, the auxiliary housing 7 is made of relatively hard panels, and accordingly, the travel bag having the auxiliary housing 7 is not applicable to general bags made of flexible materials, that is, textiles.

The present invention relates to an improvement in the travel bag having the variable storage chamber according to the prior art, thereby being more convenient to use.

SUMMARY OF THE INVENTION

Accordingly, the present invention has been made in view of the above-mentioned problems occurring in the prior art, and it is an object of the present invention to provide a travel bag having an extra storage compartment that is capable of allowing the extra storage compartment made of flexible materials, that is, textiles, not made of hard materials to be coupled simply to the top thereof by means of a zipper or hook buttons, so that the travel bag can be widely applied to a variety of travel bags.

To accomplish the above-mentioned object, according to the present invention, there is provided a travel bag having casters mounted on the underside thereof and a slide-type handle mounted on the top side thereof, the travel bag including: an extra storage compartment of a given height attached to the top thereof and having fold lines formed on both side surfaces thereof in such a manner as to be connected from top center points to both side corners and hook buttons attached to the top thereof, whereby while the travel bag is not used, the extra storage compartment is folded toward the travel bag, and while the travel bag is used, the extra storage compartment erects to the given height through the unfastening of the hook buttons from each other.

According to the present invention, the configuration of the prior art wherein the auxiliary storage chamber is temporarily formed on the top of the travel bag in such a manner as to be slidingly moved up and down is improved so that the extra storage compartment of the travel bag according to the present invention is not made of hard panels, but made of flexible textiles, and it is attached foldably to the top of the travel bag. While the travel bag is not used, accordingly, the extra storage compartment is kept to come into close contact with the top of the travel bag, and while the travel bag is used, it is developed and folded upward to form an extra storage chamber, so that when a traveler goes through immigration formalities at an airport or the like, his or her portable items such as a handbag, a camera, a cell phone and the like are temporarily stored in the extra storage compartment, thereby more improving the efficiencies of the travel bag.

DETAILED DESCRIPTION OF THE INVENTION

A general travel bag 1 includes a cover (cap) 2 having opening means like a zipper formed on one side surface thereof so as to allow belongings to be accommodated into the travel bag 1 therethrough, casters 11 mounted on the underside thereof, and a movable handle 5 insertedly mounted on the top thereof, so that in a state where the travel bag 1 is not used or moved, the handle 5 is inserted into the interior of the travel bag 1 to reduce the volume of the travel bag 1, and in a state where the travel bag 1 is used or moved, the handle 5 is drawn to the outside to allow the travel bag 1 to be moved to a desired place.

Figure 7:
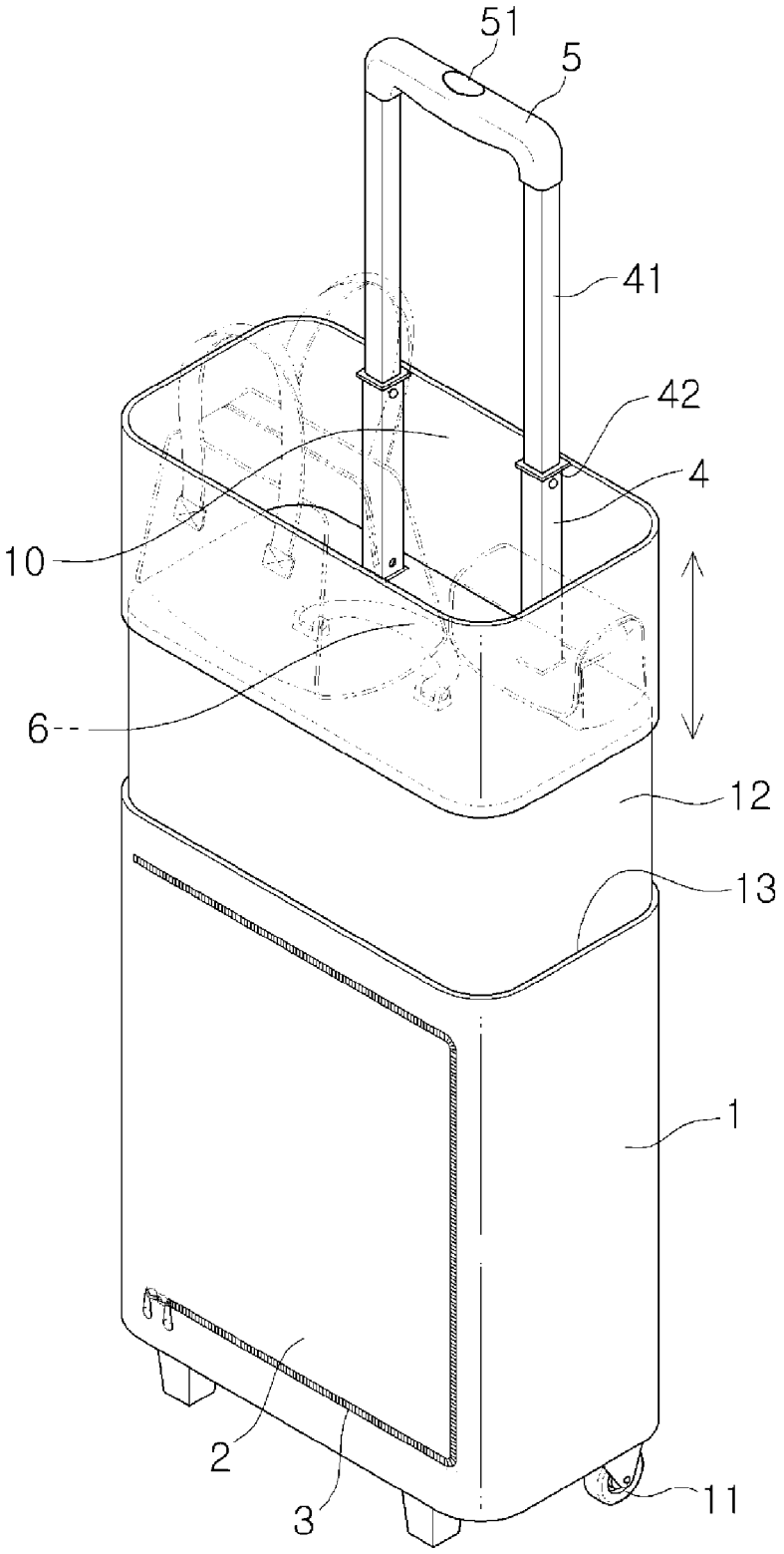
FIG. 7 (Prior Art)
FIG. 7 is a perspective view showing a travel bag having a variable storage chamber according to the prior art document.

As shown in FIG. 7, the inventor suggests the travel bag having the auxiliary housing 7 slidingly mounted on top thereof, but so as to improve the effects in the use of the auxiliary housing 7, the present invention provides a travel bag having an extra storage compartment 6 simply mounted on top thereof in such a manner as to be open and closed. In this case, the auxiliary storage compartment 6 is not made of hard panels, but made of flexible textile materials.

Figure 1:
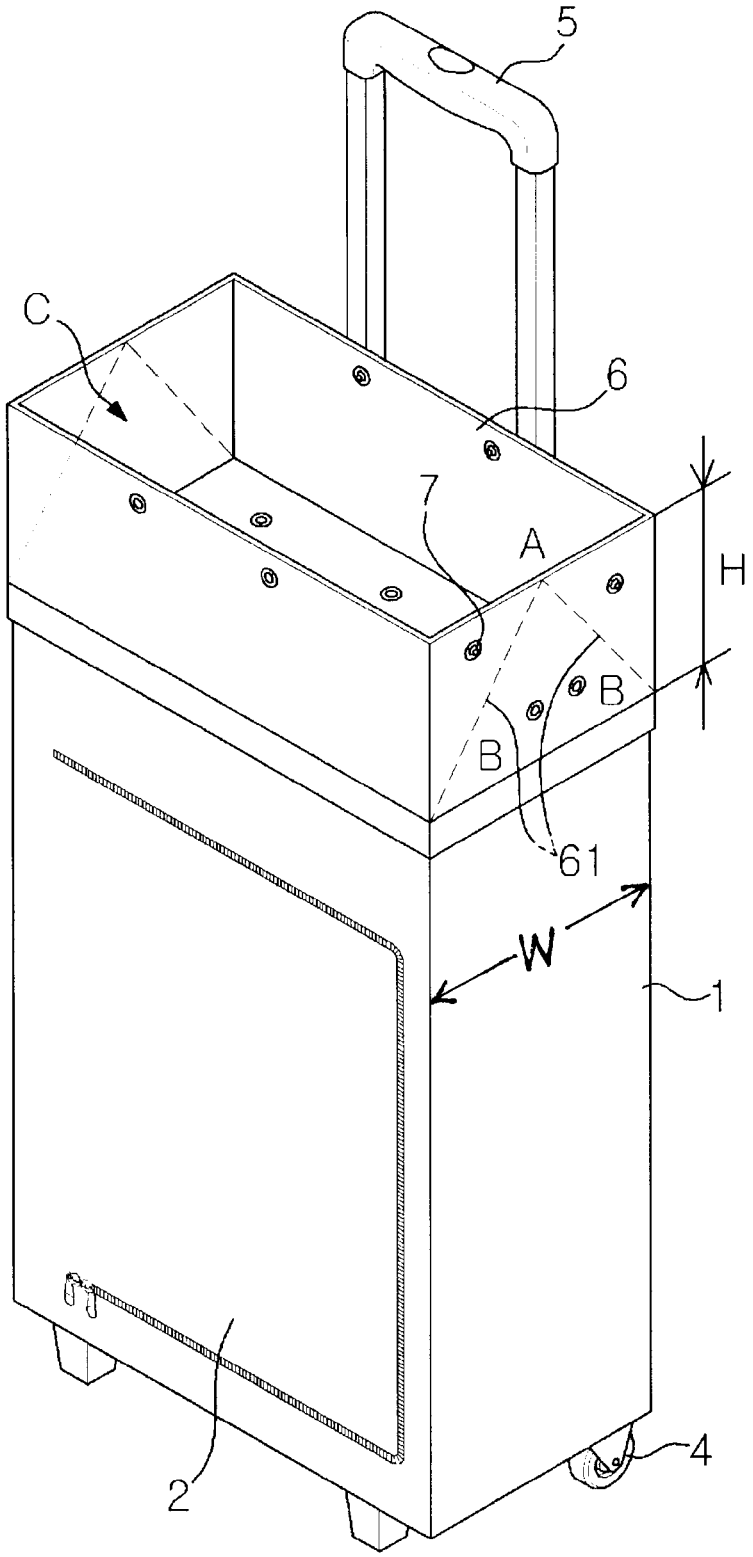
FIG. 1 is a perspective view showing a travel bag having an extra storage compartment according to a first embodiment of the present invention.
Figure 2:
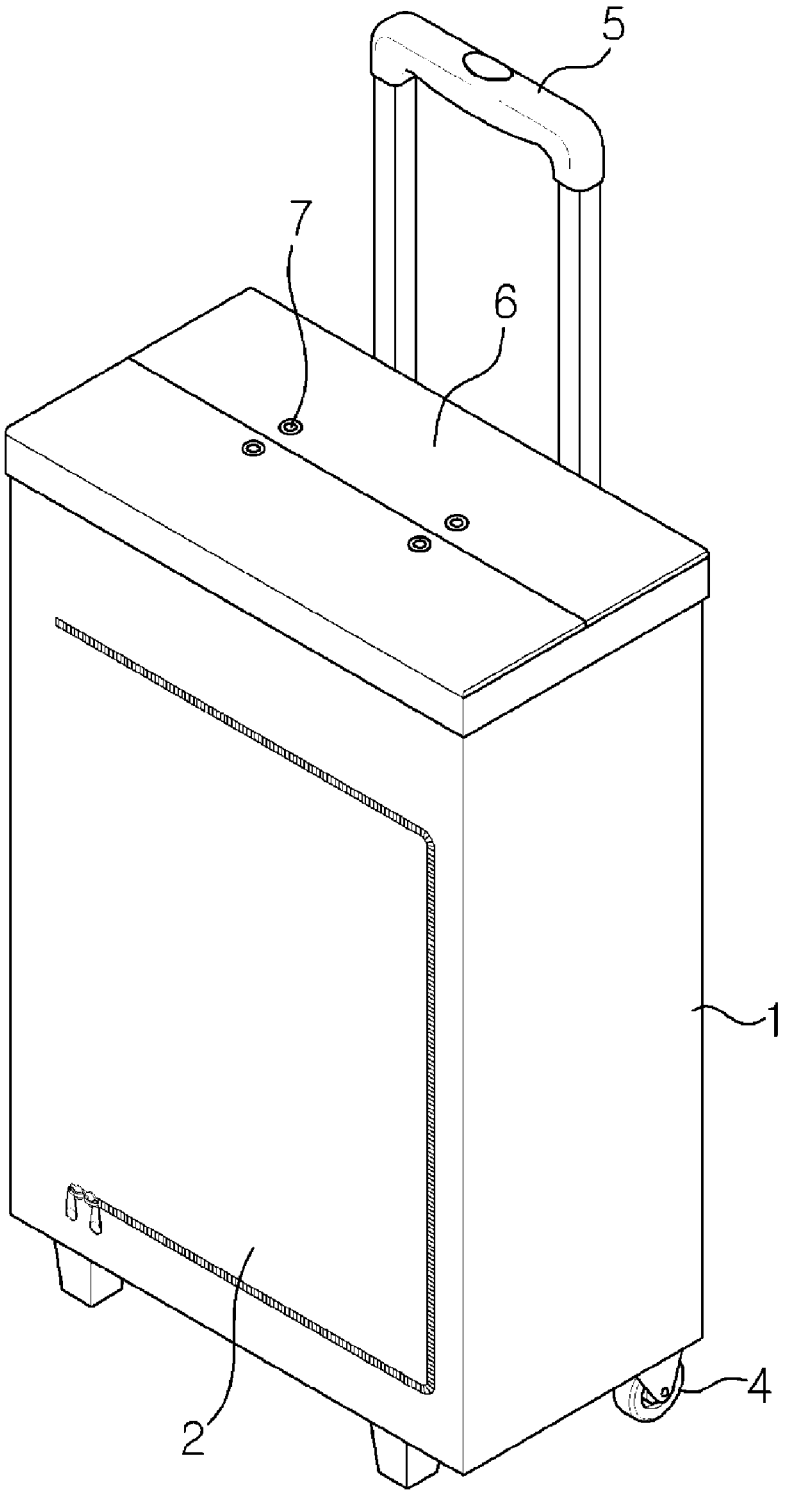
FIG. 2 is a perspective view showing the normal state of the travel bag having an extra storage compartment according to the first embodiment of the present invention.
Figure 3:
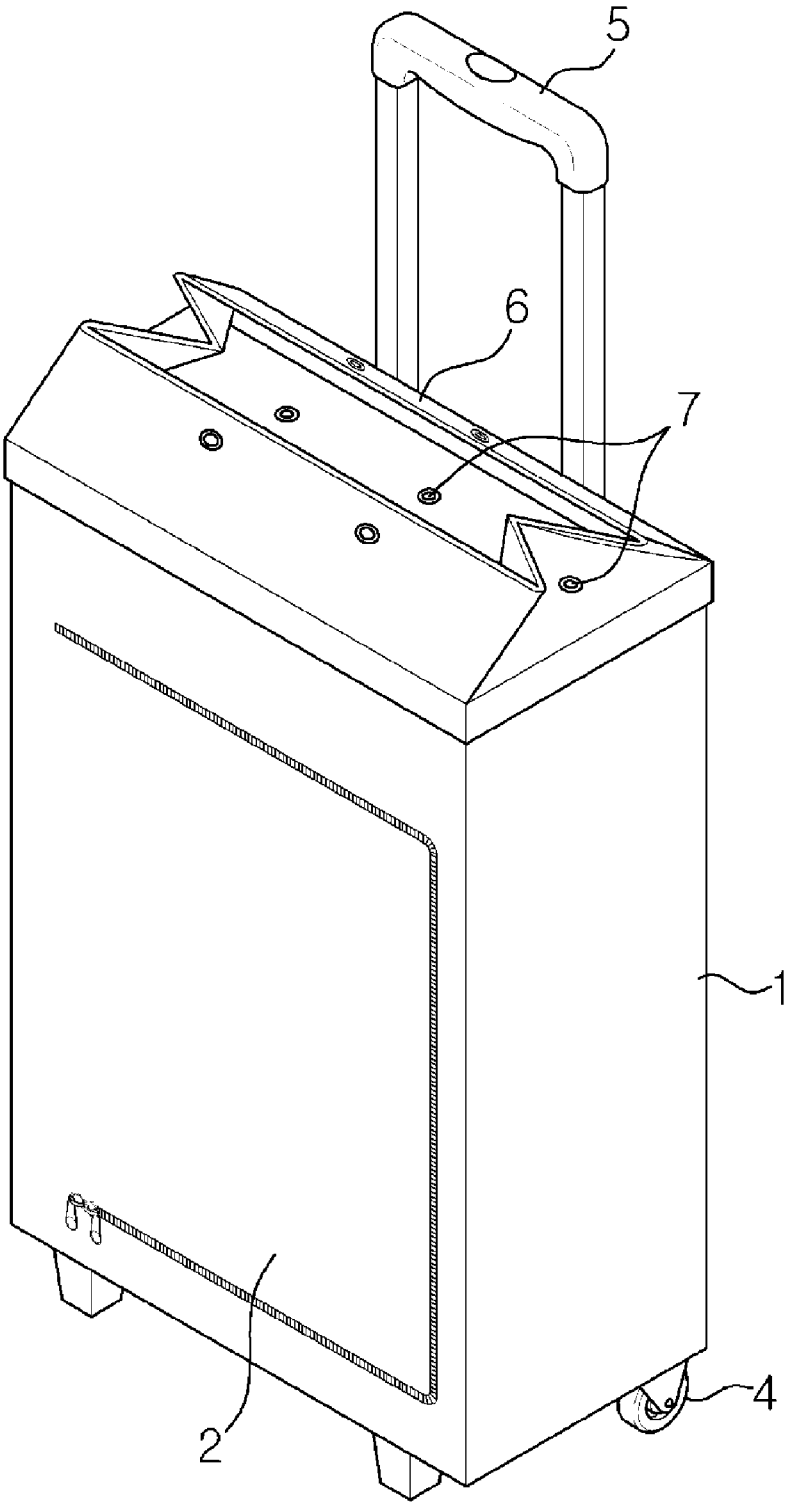
FIG. 3 is a perspective view showing the operating state of the travel bag having an extra storage compartment according to the first embodiment of the present invention.
Figure 4:
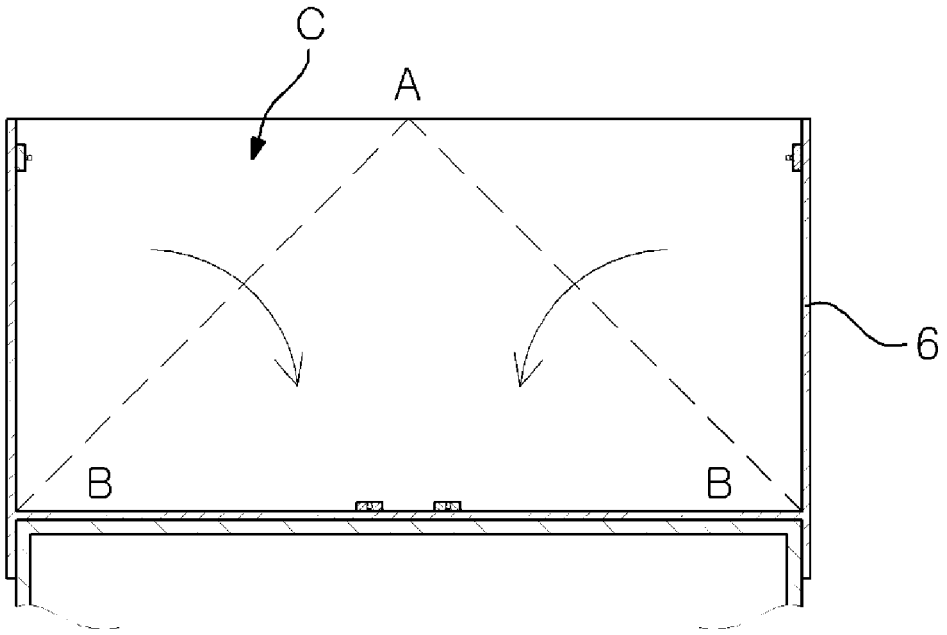
FIG. 4 is a sectional view showing the state where an extra storage compartment erects from the travel bag according to the first embodiment of the present invention.
Figure 5:
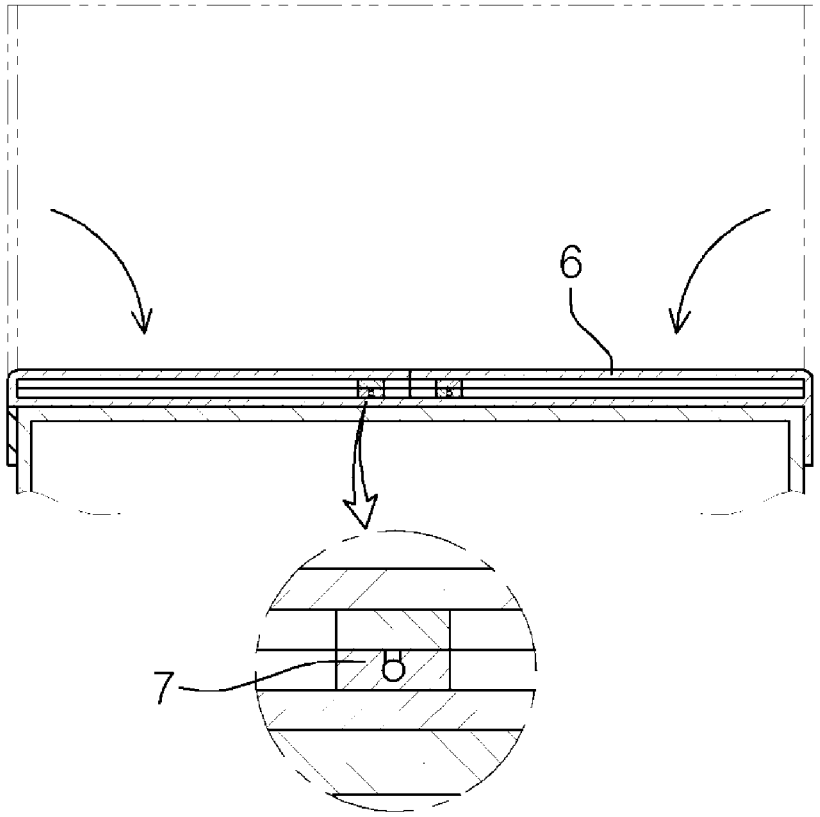
FIG. 5 is a sectional view showing the state where the extra storage compartment of FIG. 4 is folded.

FIGS. 1 to 3 show the configuration of a travel bag having an extra storage compartment according to a first embodiment of the present invention, and a travel bag 1 having an extra storage compartment according to a first embodiment of the present invention is configured to have the extra storage compartment 6 fixedly attached to the top thereof in such a manner as to have a given height H. The extra storage compartment 6 is made of a relatively thick textile material or vinyl material for bags which has given flexibility and erects upward.

The extra storage compartment 6 has fold lines 61 formed diagonally on corners B so that it can come into close contact with the top of the travel bag 1 while not used.

The fold lines 61 are formed through thermo-compression means upon the manufacturing of the extra storage compartment 6 so as to easily fold the material of the extra storage compartment 6.

The fold lines 61 are formed symmetrically on left and right sides in such a manner as to be connected from top center points A on the two faces having the small widths among the four faces of the extra storage compartment 6 to both side corners B on the bottom thereof.

While the travel bag 1 is normally kept or moved to a given place, the extra storage compartment 6 is folded in such a manner as to come into close contact with the top of the travel bag 1, as shown in FIG. 2, and if an extra storage space is needed during the use of the travel bag 1, the extra storage compartment 6 erects upward, as shown in FIG. 1.

So as to maintain the extra storage compartment 6 at the folded state, the travel bag 1 further includes hook buttons 7 formed of pairs of male and female buttons mounted on the center portion or the left and right edge portions of the extra storage compartment 6.

In case where the travel bag 1 is normally kept at a given place or moved to another place, the hook buttons 7 are fastened to each other, and as shown in FIG. 2, accordingly, the extra storage compartment 6 comes into close contact with the top of the travel bag 1, thereby maintaining a compact volume, without having any bad influence on the outer appearance of the travel bag 1.

If an extra storage space is needed to keep belongings thereinto during the use of the travel bag 1, for example, in front of an immigration inspection stand at an airport, the fastening states of the hook buttons 7 are released to erect the wall surfaces of the extra storage compartment 6 upward, so that the wall surfaces of the extra storage compartment 6 in every direction can stand up vertically as shown in FIG. 1 by means of the fold lines 61 during the folding process as shown in FIG. 3, thereby allowing an extra storage chamber C to be simply formed in the interior of the extra storage compartment 6.

Accordingly, a traveler's belongings such as a handbag, camera, cell phone, and so on are conveniently stored in the extra storage compartment 6, and if necessary, all kinds of items purchased in his or her travel place are further kept in the extra storage compartment 6.

After the use of the extra storage compartment 6 is finished, the items stored therein are drawn, and after that, if the sides (having long widths) of the extra storage compartment 6 push, the four side plates of the extra storage compartment 6 are folded simply to each other during the intermediate folding process as shown in FIG. 3 through the fold lines 61 and come into close contact with the top of the travel bag 1, as shown in FIG. 2. At this time, if the folded corners B are slightly pressed one more time, the hook buttons 7 are fastened to each other to allow the extra storage compartment 6 to be contactedly coupled to the top of the travel bag 1.

Figure 6:
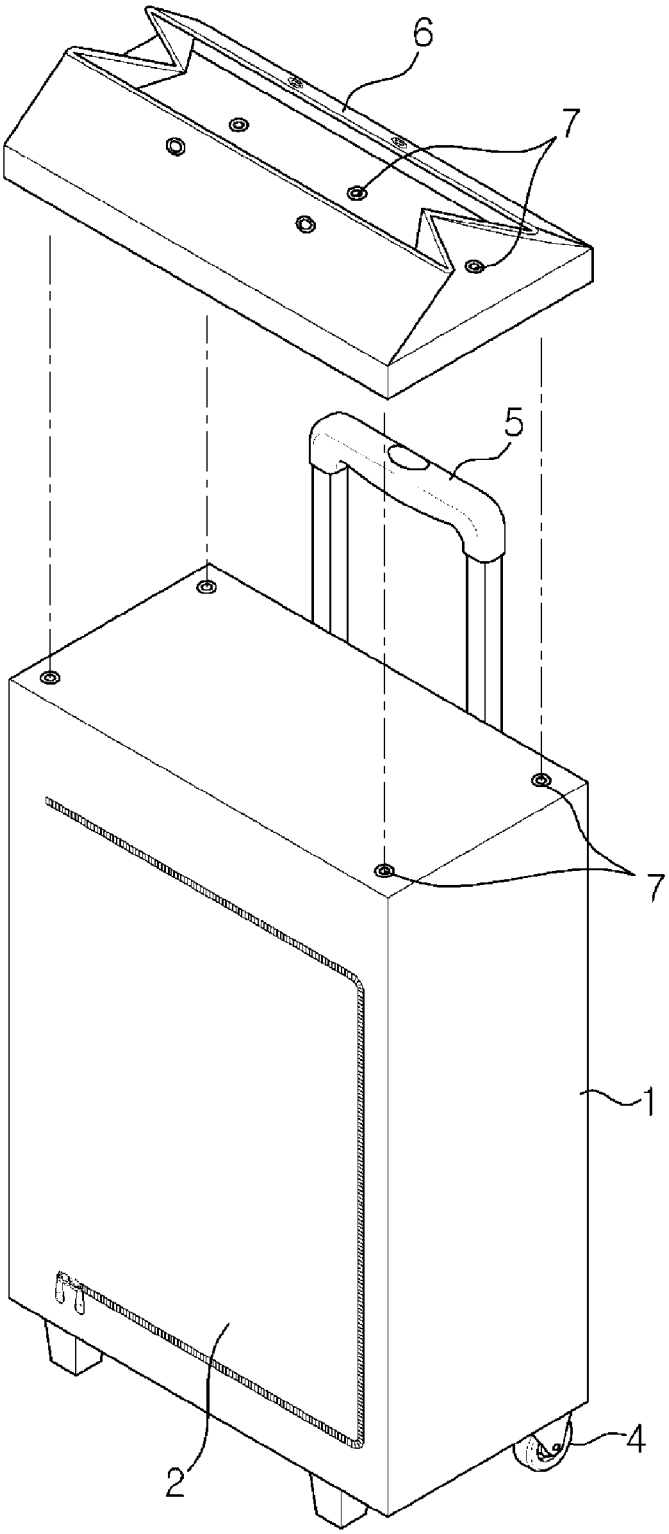
FIG. 6 is a perspective view showing a travel bag having an extra storage compartment according to a second embodiment of the present invention.

FIG. 6 is a perspective view showing a travel bag having an extra storage compartment according to a second embodiment of the present invention, wherein the extra storage compartment 6 is separable from the travel bag 1. That is, the extra storage compartment 6 is attached integrally to the top of the travel bag 1 according to the first embodiment of the present invention, but the extra storage compartment 6 is detachably coupled to the top of the travel bag 1 through fastening means like hook buttons 7 according to the second embodiment of the present invention. If the extra storage compartment 6 is not needed, accordingly, it is detached from the travel bag 1 and is kept separately, but if needed, it is coupled to the travel bag 1 by means of the hook buttons 7, thereby providing the travel bag 1 having an extra storage chamber.

As described above, the travel bag 1 according to the present invention has the extra storage compartment 6 additionally formed through assembling and folding in one touch manner, thereby allowing the traveler's portable items to be temporarily stored in the extra storage compartment 6 at an airport or the like.

The present invention relates to the travel bag having the extra storage compartment, which is useful in industrial applicability.

What is claimed is:

1. A travel luggage comprising:

a main bag with a handle coupled thereto and casters mounted on an underside thereof; and an extra storage compartment attached to an upper side of the main bag, the extra storage compartment composed unitarily of a front wall member, a rear wall member, a left side wall member, a right side wall member, and a bottom wall member, and thereby defining an open space toward an upper side of the extra storage compartment, each of said front, rear, left side, and right side wall members having a generally rectangular shape with an upper edge, a lower edge, a left side edge, and a right side edge, wherein each of the left side wall member and the right side wall member includes symmetrical fold lines formed with a first fold line extending from a center point at the upper edge of the respective wall member to a corner point where the lower edge and the left side edge meets, and a second fold line extending from the same center point at the upper edge of the respective wall member to a corner point where the lower edge and the right side edge meets, such that the extra storage compartment can be folded to a folded shape with the front wall member, the rear wall member, the left side wall member, and the right side wall member adjoining the bottom wall member by folding the left side wall member and the right side wall member along the symmetrical fold lines thereof, wherein the extra storage compartment includes fastening members formed, at least, at the front wall member, the rear wall member, and the bottom wall member for fastening together and keeping the extra storage compartment in the folded shape after folding, the fastening members including at least two formed at an upper side of the front wall member and at least two formed at an upper side of the rear wall member, and at least four formed at corresponding locations of the bottom wall member to couple with the fastening members of the front wall member and the rear wall members.

2. The travel bag according to claim 1, wherein the fastening members are in the form of hook buttons configured to couple with corresponding ones.

3. The travel bag according to claim 1, wherein each of the front wall member, the rear wall member, the left side wall member, and the right side wall member of the extra storage compartment has a height (H) which is about one half of a width (W) of the left and right side wall members.

4. The travel bag according to claim 1, wherein the fastening members are formed at each of the front wall member, the rear wall member, the left side wall member, and the right side wall member of the extra storage compartment.

5. The travel bag according to claim 4, wherein the fastening members further include four formed at the left side wall member and four formed at the right side wall member.

6. The travel bag according to claim 1, wherein the extra storage compartment is configured to be detachably attached to the upper side of the main bag by means of additional fastening members formed on the upper side of the main bag and underside of the bottom wall member of the extra storage compartment.

* * * * *